US006490761B2

(12) United States Patent
Durrant

(10) Patent No.: US 6,490,761 B2
(45) Date of Patent: Dec. 10, 2002

(54) TELESCOPING TOOL HANDLE

(76) Inventor: Randy C. Durrant, 4038 Goldcrest Dr. Northwest, Olympia, WA (US) 98502

( * ) Notice: Subject to any disclaimer, the term of this patent is extended or adjusted under 35 U.S.C. 154(b) by 0 days.

(21) Appl. No.: 09/791,173

(22) Filed: Feb. 21, 2001

(65) Prior Publication Data

US 2001/0044989 A1 Nov. 29, 2001

Related U.S. Application Data

(60) Provisional application No. 60/183,878, filed on Feb. 22, 2000.

(51) Int. Cl.[7] ..... B25G 3/00; B25G 1/04

(52) U.S. Cl. ..... 16/436; 16/429; 16/110.1; 81/438; 81/177.1; 81/177.2

(58) Field of Search ..... 16/436, 429, 405, 16/110.1; 81/490, 439, 438, 489, 58, 58.1, 177.1, 177.4, 492

(56) References Cited

U.S. PATENT DOCUMENTS 1,030,592 A * 6/1912 Leland ..... 135/75
1,269,413 A * 6/1918 Finnigan ..... 112/80.03
1,753,441 A * 4/1930 Morehouse ..... 279/76
2,592,978 A * 4/1952 Trimboli ..... 16/429
2,963,930 A * 12/1960 Clothier et al. ..... 285/303
3,306,639 A * 2/1967 Lyon ..... 16/429
4,376,397 A * 3/1983 Newby et al. ..... 16/429
4,586,406 A * 5/1986 Howard ..... 16/429
5,515,754 A * 5/1996 Elkins ..... 403/106
5,533,429 A * 7/1996 Kozak ..... 81/438
5,931,065 A * 8/1999 Jackson et al. ..... 81/177.1

* cited by examiner

*Primary Examiner*—Chuck Y. Mah
(74) *Attorney, Agent, or Firm*—Angenehm Law Firm; N. Paul Friederichs

(57) ABSTRACT

An apparatus for telescopically extending the shaft length of a tool including a handle with a circular or noncircular hollow core shaft with at least one longitudinal extension channel, a circular or noncircular hollow shank wherein one end has an internally threaded drive ring with at least one tab for insertion into an extension channel, and the second end has a head assembly to receive various tool fittings where an externally threaded adjusting rod extends into the hollow shank and is engaged in the threaded drive ring and is operated by a rotatable adjusting knob is attached to the adjusting rod, and a lock assembly is used to selectively eliminate rotation of the knob; the lock assembly comprises a pair of facing spline faces which engagingly prevent rotation of the knob.

21 Claims, 3 Drawing Sheets

TELESCOPING TOOL HANDLE

The present application claims priority from provisional patent application No. 60/183,878 entitled TELESCOPING TOOL HANDLE, filed Feb. 22, 2000.

BACKGROUND OF THE INVENTION

This invention relates generally to the field of hand tools, and more particularly to an apparatus for telescopically extending the shaft length of a tool used for turning a fastener or the like while protecting the critical mechanisms for extending the tool shaft by moving the mechanism inside the handle. An additional feature of the invention is adaptation to use multiple replaceable tool ends for performance of multiple tasks.

All too often, the problem is found in the field, when a user must access a fastener that is in difficult location. Traditionally, a user must have available for ready access tools of multiple lengths. Short tools must be available for working in restricted spaces, long tools must be available for reaching the tool into a restricted space or moving the user away from the fastener.

Short or "stubby" tools are useful and often necessary for working in a confined space, but, suffer from an additional shortcoming of being small and therefore having small handles that are frequently difficult to grasp and apply sufficient torque to the fastener. While longer tools do not suffer the same shortcoming's as short tools they have there separate problems, including being large and therefore difficult to store.

As a result, most conventional screwdrivers and tool handles are of medium length and perform adequately in most circumstances, but, cannot be used in all circumstances necessitating the user owning and using multiple drivers as the task requires.

SUMMARY OF THE INVENTION

The tool industry over the years has innovated new and useful tool designs to meet specific industry requirements for additional tool utility. Tools of multiple functionality have entered the tool industry, and have found valued place in many tool boxes. Telescoping shaft length tools can improve work efficiency by reducing the number of tools of that a user must have available for use. Thus a user can perform more work in a given time.

The invention is to provides a telescoping shank for telescopically extending the length of a screw driver, socket end, or a wrench; making the tool more versatile than existing tools having a smooth, non-threaded shank, which is easy and relatively inexpensive to manufacture. The telescoping mechanisms is housed internally in the tool handle, providing protection to these critical mechanisms, and making the tool more dependable, and of greater utility.

The telescoping of the tool is controlled by a lockable adjustment knob located on the end of a handle so that a user can easily alter the length regardless of the location of the tool. The telescoping shank is nonremovable and can be integrated into a handle minimizing the size of the tool while protecting the adjustment mechanism.

An apparatus for telescopically extending the shaft length of a tool, comprising: a handle with a circular or noncircular hollow core shaft with at least one longitudinal channel in combination with a hollow shank with circular or noncircular cross section, with integral, internally threaded drive ring on one end. The drive ring has at least one associated tab for insertion into the longitudinal channel. The second shank end has a head assembly to receive screw driver, socket, or wrench tool fittings. Circular shaft and shank cross sections are associated with the screw driver or socket configuration, in addition, a noncircular or elliptical cross section is associated with a wrench configuration. An externally threaded adjusting rod engages the threaded drive ring, and extends into the hollow shank. A rotatable adjusting knob is attached to the adjusting rod. A lock mechanism which is integral to the adjusting knob attached to the handle which is used to selectively eliminate rotation of the knob. The lock assembly comprises a first friction washer attached to the knob and a second friction washer attached to the handle wherein the washers engage each other to prevent rotation of the knob. Alternatively, the lock assembly comprises a first splined portion attached to the knob and a second splined portion attached to the handle wherein the portions engage each other. A spring, and spring retainer system is attached to the adjusting rod to provide engaging force on the splined portions. A key is attached to the adjusting rod as a means of transferring rotational force between the adjusting knob and the adjusting rod.

DESCRIPTION OF THE PREFERRED EMBODIMENT

Figure 1:
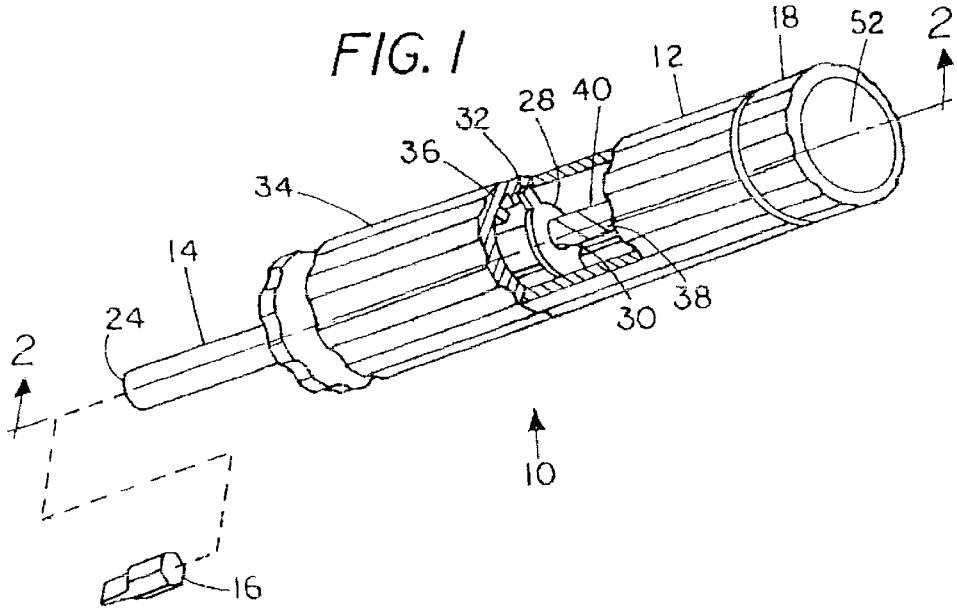
FIG. 1 is a perspective view showing the first embodiment of a telescoping tool according to the present invention; showing a partial cut away internal view of the drive mechanism.

Referring first to FIG. 1, which shows a first embodiment of the telescoping shafted tool 10. The first embodiment is generally in the form of a screwdriver having a handle 12 and a shaft 14 adapted to receive a conventional replaceable tip 16. The tool 10 additionally has an adjustment knob 18 for extending or retracting the shaft 14 of the tool 10. The extension mechanism 20 of the tool 10 is contained within the handle 12 and attached to both the adjustment knob 18 and the shaft 14.

The shaft 14 is a hollow tube that, while being shown as circular in cross section, need not be circular and is formed having an adapter 22 on the distal end to receive a replaceable tip 16. A standard replaceable tip 16 is formed from a ¼ inch hexagonal rod and has a point on the one end for mating with a screw head or nut. The point may be a flat blade, phillips, Torx,® Robertson,® or a nut driver having a female hex for accessing a standard hex nut. It is preferred, therefore that the internal hollow 24 of the shaft 14 be in the form of a regular ¼ inch hexagon to utilize standard replaceable tips 16. Standard replaceable tips 16 are a fungible item well known in the art and readily available in the marketplace.

The shaft further can have a means for retaining the replaceable tips 16 contained within the hollow 24. The means for retaining the replacement tips 16 are well known in the art and can include a magnet for magnetically holding the tips 16 and various mechanical mechanisms such as deformable clips or deformable rings contained within the hollow portion 24 of the shaft 14. Alternately, the retaining means may be may be constructed as part of the replaceable tip 16.

The shaft 14 may be constructed from any one of a number of materials, including, metals or polymers having the necessary properties of workability, strength, and durability. A preferred material is a ferrous alloy.

The proximal end 26 of the shaft carries the drive mechanism 28 which is a hollow plug having an internal threaded hole 30 and a pair of extending drive tabs 32 which mate with the handle. The drive mechanism 28 may be constructed from any suitable material such as a metal, or a hard polymer and is preferably constructed from a ferrous alloy having suitable properties, which include, strength, durability and workability. Additionally, the drive mechanism must slide within the channels 36 of the handle 12 without excessively wear or galling the channels 36. The drive mechanism 28 may be constructed integral with the shaft 14 or may be fabricated separately and attached using any suitable means of attachment, such as, welding, fusing, discrete fasteners, or adhesives.

The handle 12 is constructed, generally, as an elongate cylinder a length and diameter sufficient to contain the drive mechanism 28 and the extension mechanism 20. Additionally, the handle is sized to be comfortable gripped by a user. The handle as shown in FIG. 1 has an embossed external surface 34 to cooperate with the user and provide an enhanced grip. It is understood that the handle 12 may be formed in other suitable shapes, such as, having longitudinal external flutes, or being non-circular to enhance the gripability.

The handle 12 is at least partially hollow to contain the drive mechanism 28 and the extension mechanism 20. The handle further has a pair of internal channels 36 for receiving the drive tabs 32. While a pair of drive tabs 32 and channels 36 is preferred, it is understood that at least one is required. The internal channels 36 extend from the proximal end of the handle 12, adjacent the adjustment knob 18 longitudinally to near the distal end of the handle 12. The internal channels 36 limit the longitudinal movement of the drive mechanism 28, and therefore the extension of the shaft 14. The channels 36 extend from the proximal end of the handle 12 essentially the length of the hollow portion of the handle limiting the longitudinal extension of the drive mechanism 38. A plug 37 may be inserted into the hollow in the proximal end of the handle 12 to retain the drive mechanism 28 and limit the contraction of the drive mechanism 38.

The handle 12 may be constructed from any number of suitable materials, such as, hard polymers, metals, or hard fine grained wood having the necessary properties of strength, durability, and workability. When the handle is constructed from a polymer, the polymer may be opaque, translucent, or transparent. In some of the embodiments, as described below, it is. preferred that the polymer be transparent or translucent. Additionally, the handle 12 or at least the portion of the handle forming the internal channels 36, must have sufficient durability to allow the repetitive sliding of the drive tabs 32 therealong. Preferably, the drive tabs 32 and the internal channels 36 will be self-lubricating to allow the sliding of the drive tabs 32 without excessive wear. Alternately, a separate lubricant may be used to reduce wear between the drive tabs 32 and the channels 36.

The adjustment knob 18 is attached to the proximal end of the handle 12. The adjustment knob 18 may be of any suitable shape such as round, oval, or "T" shaped and may be sized having either larger or smaller diameter than the handle 12. The size of the adjustment knob 18 may have a larger diameter to enhance the ease of gripping by the user, the maximum size is limited only that as the size grows larger, the ability to use the telescoping extension tool 10 in a restricted space becomes compromised. Similarly, the diameter of the adjustment knob 19 may be smaller than the diameter of the handle 12, the minimum diameter of the of the adjustment knob 18 is only limited by the dexterity of the user, that is, as the diameter of the adjustment knob 18 is reduced, it will become difficult for a user to grasp and turn, ultimately, becoming so small that another tool becomes necessary to grasp the adjustment knob 18.

The adjustment knob 18 may be constructed from any suitable material, such as, metal, polymers, or hard wood. It is preferred that he adjustment knob 18 be constructed from the same material as the handle 12. The periphery of the adjustment knob 18 may be smooth or have an embossed pattern or a polygonal or otherwise irregular shape to enhance the ability of the user to grip and turn the adjustment knob 18. The adjustment knob 18 may be attached to the adjustment rod 38 using any suitable method of attachment such as press fit, welding or fusion, or mechanical fasteners. One preferred example of attachment includes the formation of internal grooves on the periphery of a center hole in the adjustment knob 18 and forming mating external ridges on the outer surface of the adjustment rod 38. Alternately, at least one key 35 may be used to retain the adjustment knob 18 and prevent rotation upon the adjustment rod 38. When keys 35 is used, keyways must be milled in the adjustment rod 38 and matching keyways in the in adjustment knob 18.

The adjustment knob 18 has an adjustment rod 38 extending longitudinally therefrom. The adjustment rod 38 extends from the adjustment knob 18 through the internally threaded hole 30 or the drive mechanism 28 and is externally threaded to engage the internal threads of the threaded hole 30. The threads 40 are preferably of quite coarse pitch such as one to three threads per inch so that very few turns of the adjustment knob 18 will move the extension mechanism 20 through the entire range of motion. The adjustment rod 38 may be constructed from any suitable material having sufficient strength and durability. Suitable materials would include hard polymers and metals. Preferably, the adjustment rod 38 is constructed from an iron alloy the is suitable to engage the threaded hole 30 and sufficiently durable so that there is a minimum of wear between the parts.

Figure 4:
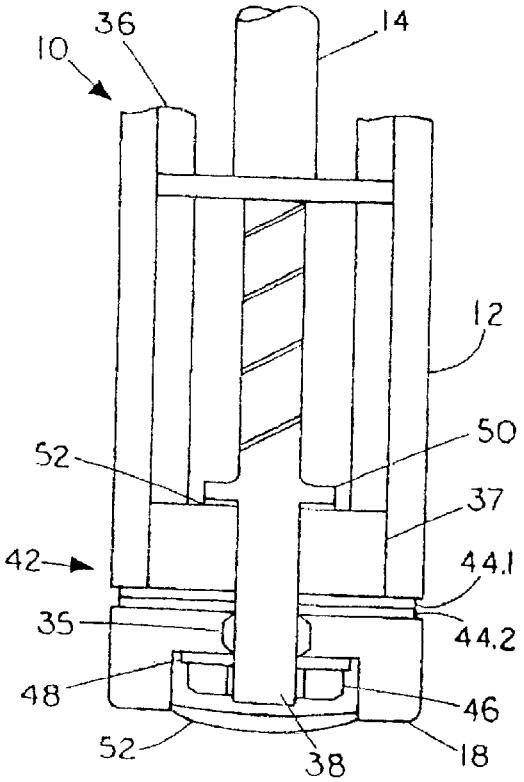
FIG. 4 is a partial cut away view of the first embodiment of the telescoping tool handle showing the adjustment mechanism and the locking mechanism.
Figure 5:
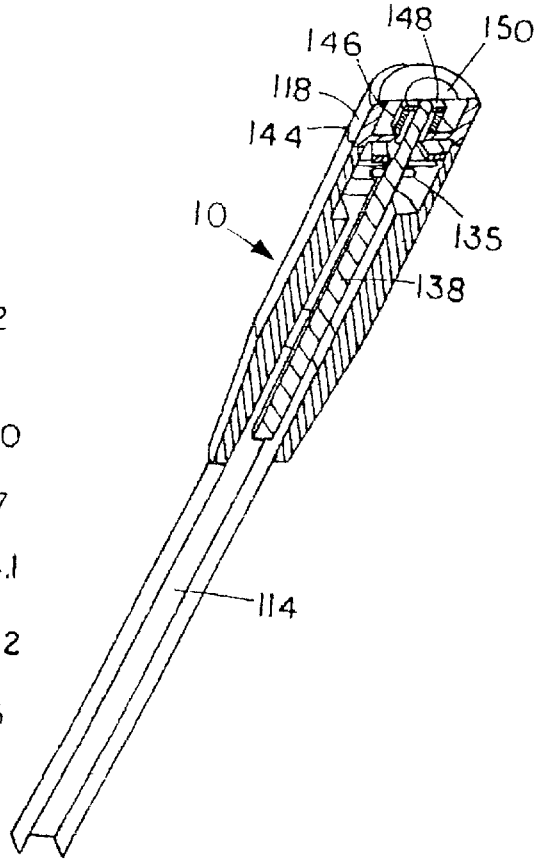
FIG. 5 is a longitudinal cross sectional view of a second embodiment of the telescoping tool handle showing the alternate shank construction.

The locking mechanism 42, as shown in FIG. 4, consists of a pair of friction washers 44.1, 44.2 which when urged together restrict or prevent the rotation of the adjustment knob 18 with respect to the handle 12. The locking mechanism further 42 further includes a lock knob 46 and a thrust washer 48. The lock knob 46 is threadedly attached to the proximal end of the drive rod 38 using the lock knob 46. A thrust face 50 is an expanded diameter portion formed on the adjustment rod 38 for engaging the distal face of the plug 37 so that when the lock knob 46 is tightened, the adjustment knob 18, the locking washers 44, the plug 37 and the adjustment rod 38 are drawn together and prevented from rotating with respect to each other.

While it is not necessary, it is preferred that a protector cap 52 be included to cover the locking knob 46. The protector cap 52 is used to protect the threads of the locking knob 46 from environmental debris or abuse from the user. The protector cap 52 may be fabricated from any suitable material, such as metal, polymers, or wood. It is preferred that the protector cap be formed from the same polymer as the handle 12 and be molded integral with the handle 12.

Figure 3:
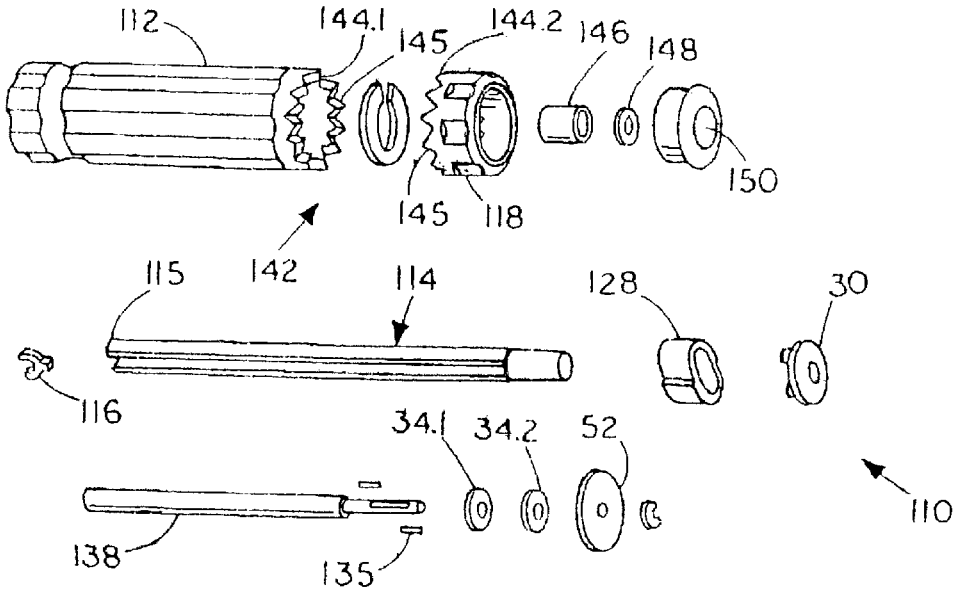
FIG. 3 is an exploded view of the telescoping tool handle showing an alternate embodiment of the locking mechanism.

In another embodiment of the invention 110 as shown in FIG. 3, shows an alternate embodiment of the shaft 114 and its assembly and the preferred embodiment of the locking mechanism 142 adapted to accept replaceable tips 116 designed to grip and thereby turn standard hexagonal nuts.

While the drawings show a round shaft 114, in this embodiment, the shaft 114 may be and is preferably polygonal square in cross section. When a non-round shaft 114 is used, drive mechanism can be modified to obviate the drive tabs 132 as the shaft 114 can be fitted in an appropriately shaped hole to receive the limited torque loads of this embodiment.

Figure 6:
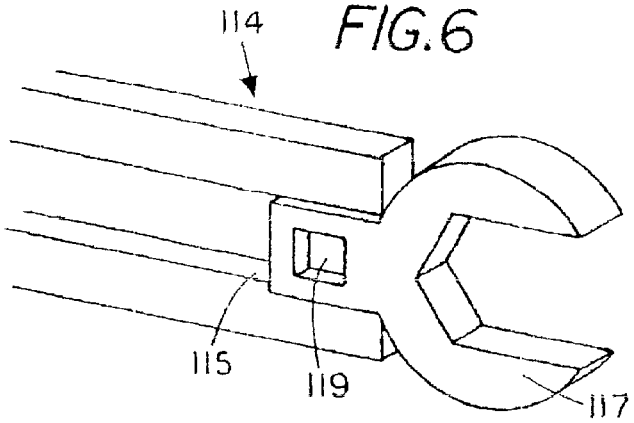
FIG. 6 is detailed partial view of the second embodiment of the telescoping tool handle showing a crow-foot wrench attached.
Figure 7:
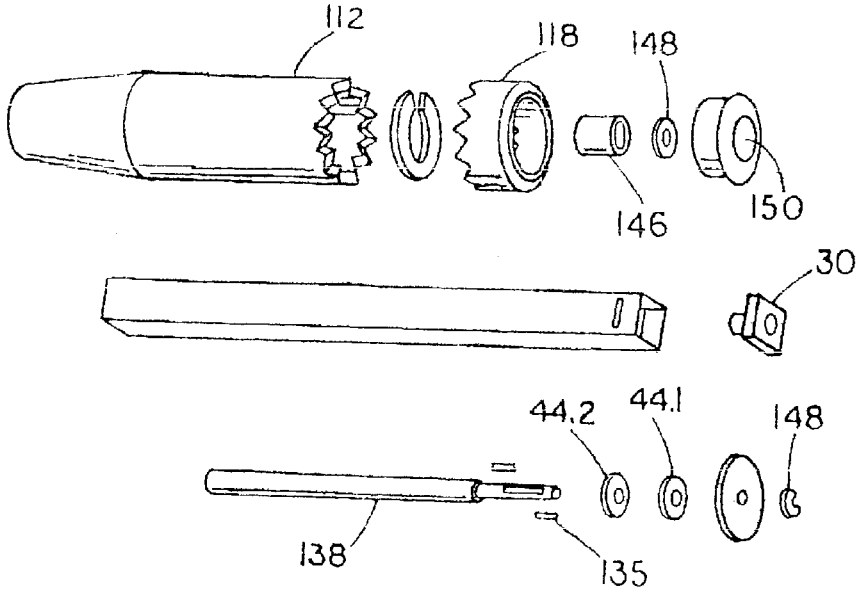
FIG. 7 is a partial exploded view of the second embodiment of the telescoping tool handle showing the alternate locking mechanism.

In this embodiment, the shaft 114 has been modified by changing the cross sectional shape to a rectangular tube, or a "C" shaped channel, as shown more clearly in FIG. 6. The replaceable tip, commonly called a crow foot wrench 117 has been placed into the shaft 114. The crow foot wrenches 117 are designed to be placed on the end of a square drive wrench or extension as evinced by the square recess 119 formed therein, and be used to access standard sized hexagonal nuts in otherwise inaccessible restricted spaces. It has been discovered that the crow foot wrenches can be gripped by the outer edges and used as a replaceable tip on a linear wrench, functioning much like a variable length open end wrench.

The shaft 114 is rectangular in shape is sized to allow a user to apply a pushing or pulling force to the handle 112 to rotate a hex nut held in the crow foot wrench 117. This requires the shaft to be resilient yet essentially non-bendable along its length. The shaft 114 may be fabricated from numerous material having the desired properties, such as various metals, polymers, or glass filled polymers. It is preferred that the shaft be constructed from a steel alloy.

The shaft 115 has an interior opening or channel 115 sized to receive a crow foot wrench 117, as shown in FIG. 6. The fit of the crow foot wrench 117 to the channel should be a close or interference fit so that the crow foot wrench is retained during use, but, can be readily removed when another replaceable tip 116 is needed.

Figure 2:
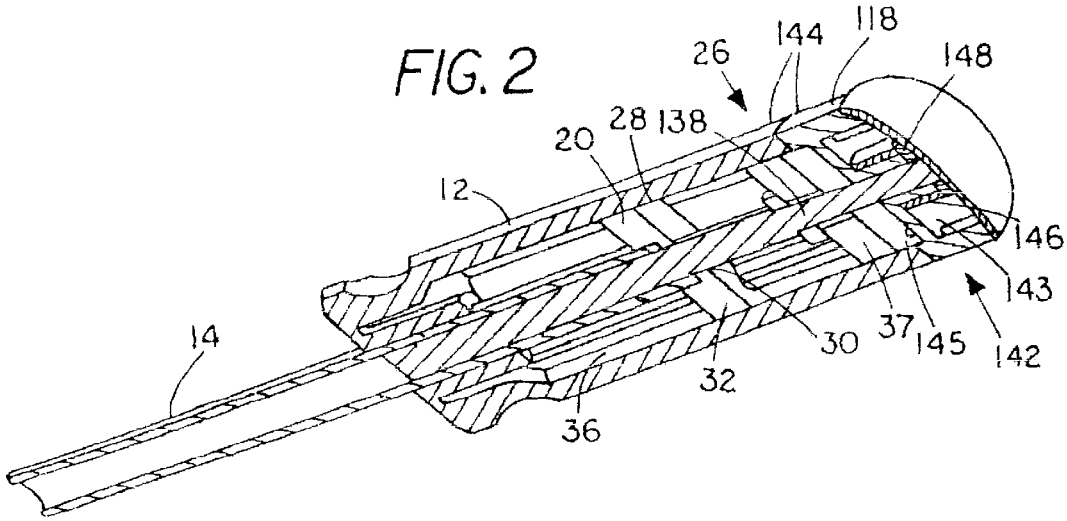
FIG. 2 is a longitudinal sectional view taken along the plane of line 2—2 of FIG. 1

The preferred embodiment of the locking mechanism 142, as shown in the exploded view of FIG. 3 consists of a pair of mating splined faces 144, the first splined face 144.1 is formed on the proximal end of the handle 112 and the second splined face 144.2 is formed on the distal end of the adjustment knob 118. The splined faces 144 are shown as having a multiplicity of approximating a "V" shaped teeth 145 in FIG. 2 and approximately gear shaped teeth 145 in FIG. 3. This merely shows two of the many shapes the teeth 145 of the splined faces 144 may have. The teeth may also be shaped as intermeshing rectangles or intermeshing curved surfaces. In one embodiment, the teeth 145 of the one splined face 144.1 are approximately parabolic is shape and the teeth 145 of the other splined face 144.2 are shaped as a mating negative parabola. It is preferred that at least one of splined faces 144 have somewhat pointed teeth. The shape of the teeth 145 can be varied, and by having at least one of the splined faces 144 having pointed teeth 145, the adjustment knob 118 becomes self-locking. That is, for example, using rectangular shaped teeth, when the adjustment knob 118 is urged away from the handle 112 to disengage the splined faces 144 so that the adjustment knob 118 may be rotated with respect to the handle 112 to alter the extension of the shaft 114 and released, it is likely that the splined faces 144 will not mesh and must be manually turned, slightly, to allow the splined faces 144 to engage. While this is a minor inconvenience, it can be avoided by the use of pointed teeth 145. With pointed teeth 145, there is a minimal, if any, flat surface of splined faces 144 for the teeth 145 to rest upon, and upon release, the adjustment knob 118 will be drawn toward the handle 112 by the tension of the adjustment.

The quantity of teeth 145 on each of the splined faces 144 much correspond and the actual number may vary in different applications. The number of teeth 145 defines the number of increments the adjustment knob 118 can have per revolution. The selection of the number of teeth 145, is at best, a compromise between a an infinite number of teeth 145 which would allow extension of the shaft 114 to an infinite number of positions and a small number of teeth 145 which would only allow the shaft to be at a small number of extension lengths. It is preferred that there be a substantial number of teeth 145 to allow the extension of the shaft 114 to be varied in small increments. The teeth 145 also must be sufficiently, large to have sufficient strength to, withstand the repeated torque placed upon the teeth 145 in use.

The adjustment knob 118 has a center hole and an enlarged recess 143 extending inwardly from the proximal end. The adjustment knob 118 fits over the proximal end of the adjustment rod 138 and is retained thereat by the adjustment rod spring 146 and spring retainer 148. The recess 143 is then covered with a cap 150 to prevent the intrusion of debris. The adjustment rod spring 146 may be a conventional coiled metallic spring, a metallic spring of other shape, or merely a sleeve of compressible resilient material. The spring retainer 148 may be any suitable means for retaining the rod spring 146 in the desired location. The preferred spring retainer 148 is a "c" clip fitted into a circular recess near the proximal end of the adjustment rod 138.

Figure 8:
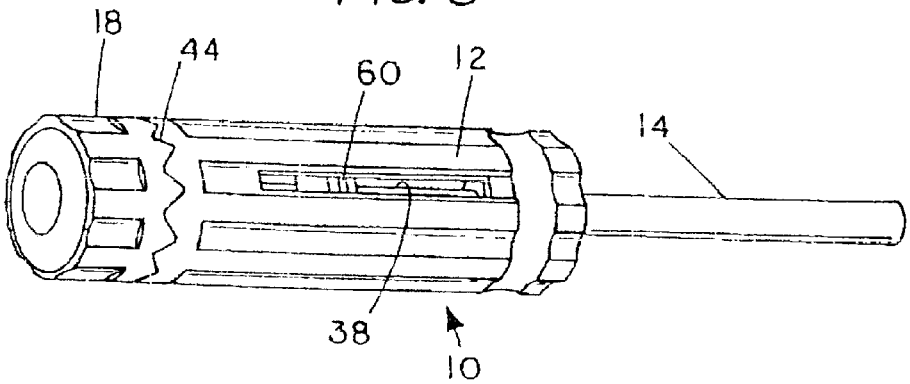
FIG. 8 is an isometric view of an alternate embodiment of the telescoping tool handle showing the transparent adjustment window.

In another embodiment of the invention 10, as shown in FIG. 8, the handle 12 has an elongate transparent window 54 on the periphery of the handle and a graduated extension scale 58 visible through the transparent window 56. A pointer 60 may be formed on one part of the extension mechanism 20 and a graduated scale 58 on an adjacent portion of the handle 12. Alternately, the pointer may be formed on the handle 12 and the graduated scale 58 formed on the plug 37.

The use of the tool 10 will be described, first, with respect to the screw driver embodiment as shown in FIG. 1 with the preferred embodiment of the locking mechanism as shown in FIG. 3. The user first selects the tool 10 from the place of storage, and if necessary, selects and inserts the proper replaceable tip 16. In the work area the user will adjust the length or extension of the shaft 114 by urging the adjustment knob 118 away from the handle 112 and rotating the adjustment knob 118 with respect to the handle 112. When the desired length of the tool 10 is achieved, the user released the adjustment knob 118 and allows the adjustment knob to seat with the splined faces 144 engaged. The user may now fit the replaceable tip 16 into the recess of the selected fastener and turn the fastener. Should the selected length be incorrect, the user need only again disengage the teeth 145 of the splined faces 144 and again rotate the adjustment knob 118 to obtain the correct length. Additionally, for storage, the shaft 114 may be fully retracted to save space.

When a tool having the first embodiment of the locking mechanism is used, to change the extension of the tool 10, the user must first remove the protector cap 52 to access the locking knob 46, the locking knob 46 is loosened which allows the adjustment knob 18 to be turned with respect to the handle 12 allowing the user to select the extension of the shaft 14 and therefore the length of the tool. When the chosen length is achieved, the user may then tighten the locking knob 46 to fix the tool 10 in its selected length for use.

With the use of a tool 10 having the second embodiment of the shaft 114, the length selecting process is as described above. The only difference is that the replaceable bit 116 selected is a crow foot wrench 117. The use of the tool 110 is also different in that the tool 110 is moved laterally by the user to rotate the fastener held in the replaceable bit 116 as contrasted with the tool 10 being rotated about its longitudinal axis in the previous embodiments.

Although the present invention has been described with reference to preferred embodiments, workers skilled in the art will recognize changes may be made in form and detail without departing from the spirit and scope of the invention.

What is claimed is:

1. A telescoping tool handle comprising:

a. means for handling, the means for handling having means for adjustment contained within the handling means and the adjustment means attached to and extending from a first end of the handling means the handling means also having a second end;

b. the adjustment means having an adjustment knob on a first end of the adjustment means and an adjustment rod extending from a second end of the adjustment means;

c. the means for locking securing the adjustment means with respect to the handling means;

d. the handling means having a handle, means for driving proximate a second end of the handling means, and a shank attached at the second end of the handling means and extending outwardly therefrom;

e. an adjustment rod being secured to the adjustment knob;

f. the adjustment rod being threaded into the driving means within the handle;

g. the driving means attached to the shank distal the handling means handle.

2. The apparatus as described in claim 1 wherein the locking means further comprises a pair of friction washers retained between the first end of the handling means and the adjustment knob and means for urging the friction washers together.

3. The apparatus as described in claim 2 wherein the means for urging the friction washers together comprises a locking knob threadedly attached to the terminal end of the adjustment rod.

4. The apparatus as described in claim 1, wherein the locking means further comprises a pair of engaging splined faces and a means for urging the splined faces into an engaged position the first splined face located on the first end of the handling means and the second splined face located adjacently on the adjustment knob.

5. The apparatus as described in claim 4 where the splines have teeth and the teeth are approximately rectangular in shape.

6. The apparatus as described in claim 4 where the splines have teeth and the teeth are pointed in shape.

7. The apparatus as described in claim 4 where the splines have teeth and the teeth of the first splined face are approximately parabolic in shape and the teeth of the second splined face are a mating negative parabola in shape.

8. The apparatus as described in claim 1 wherein the handling means further comprises at least one elongate internal channel formed in the handling means and the drive means further comprises at least one extending tab for engaging the at least one elongate internal channel in the handle.

9. The apparatus as described in claim 1 further comprising a transparently covered opening in the handling means and a pointer formed on the adjustment means and a graduated scale formed on the handle whereby, the pointer and graduated scale are viewable through the transparent opening showing the amount the tool handle is telescoped.

10. The apparatus as described in claim 1 further comprising a transparently covered opening in the handling means and a pointer formed on the handle and a graduated scale formed on the adjustment mechanism whereby, the pointer and graduated scale are viewable through the transparent opening showing the amount the tool handle is telescoped.

11. A tool comprising a. a first end of the tool joined to a second end of the tool;

b. means for applying force to said first end of the tool;

c. means for telescoping a hollow shaft coaxially from the second end of the tool, the hollow shaft further having a first end contained within the tool and a second end extendable from the tool;

d. means for attaching a detachable bit to the second end of said telescoping shaft;

e. adjustment means for adjusting the length of the telescoping hollow shaft;

f. locking means for selectively locking the hollow shaft at the selected length.

12. The apparatus as described in claim 11 wherein the force application means further comprises a handle.

13. The apparatus as described in claim 12 wherein the locking means further comprises a pair of friction washers retained between the force application means and the adjustment knob and means for urging the friction washers together.

14. The apparatus as described in claim 13 wherein the means for urging the friction washers together comprises a locking knob threadedly attached to the terminal end of the adjustment rod.

15. The apparatus as described in claim 12 further comprising a transparently covered opening in the handle and a pointer formed on the adjustment means and a graduated scale formed on the handle whereby, the pointer and graduated scale are viewable through the transparent opening showing the amount the tool handle is telescoped.

16. The apparatus as described in claim 12 further comprising a transparently covered opening in the handle and a pointer formed on the handle and a graduated scale formed on the adjustment means whereby, the pointer and graduated scale are viewable through the transparent opening showing the amount the tool handle is telescoped.

17. The apparatus as described in claim 11 wherein the force applied is torque applied axially to the elongate telescoping hollow shaft.

18. The apparatus as described in claim 11 wherein the locking means further comprises a pair of engaging splined faces and means for urging the splined faces into an engaged position the first splined face located on the first end of the force application means and the second splined face located adjacently on the adjustment knob.

19. The apparatus as described in claim 18 where the splines have teeth and the teeth are approximately rectangular in shape.

20. The apparatus as described in claim 18 where the splines have teeth and the teeth are pointed in shape.

21. The apparatus as described in claim 18 where the splines have teeth and the teeth of the first splined face are approximately parabolic in shape and the teeth of the second splined face are a mating negative parabola in shape.

* * * * *